US010353324B2

(12) United States Patent
Oura

(10) Patent No.: US 10,353,324 B2
(45) Date of Patent: Jul. 16, 2019

(54) IMAGE FORMING APPARATUS AND CONTROL METHOD

(71) Applicant: Konica Minolta, Inc., Chiyoda-ku, Tokyo (JP)

(72) Inventor: Keisuke Oura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/685,725

(22) Filed: Aug. 24, 2017

(65) Prior Publication Data

US 2018/0067423 A1 Mar. 8, 2018

(30) Foreign Application Priority Data

Sep. 8, 2016 (JP) ..... 2016-175118

(51) Int. Cl.

*G03G 15/00* (2006.01)
*G03G 15/16* (2006.01)
*B65H 23/34* (2006.01)

(52) U.S. Cl.

CPC ..... *G03G 15/1675* (2013.01); *B65H 23/34* (2013.01); *G03G 15/168* (2013.01); *G03G 15/5029* (2013.01); *G03G 15/652* (2013.01); *G03G 15/6558* (2013.01); *G03G 2215/0122* (2013.01)

(58) Field of Classification Search

CPC ..... G03G 15/168; G03G 15/5029; G03G 15/652; G03G 15/6558; G03G 2215/0122
See application file for complete search history.

(56) References Cited

U.S. PATENT DOCUMENTS

2012/0248677 A1* 10/2012 Nakamura ..... B65H 7/02 271/3.18
2015/0003883 A1* 1/2015 Honda ..... G03G 15/6529 399/406
2015/0309449 A1* 10/2015 Kakehi ..... G03G 15/1615 399/388
2017/0115611 A1* 4/2017 Fukai ..... G03G 15/6517

FOREIGN PATENT DOCUMENTS

JP S60 2559 A 1/1985
JP 2014-182153 A 9/2014

OTHER PUBLICATIONS

Extended European Search Report for EP Application No. 17189584.0, dated Jan. 18, 2018, 8 pages.
European Search Report for Application No. 17189584.0, dated Dec. 3, 2018, 5 pages.

* cited by examiner

*Primary Examiner* — David M. Gray
*Assistant Examiner* — Michael A Harrison
(74) *Attorney, Agent, or Firm* — Squire Patton Boggs (US) LLP

(57) ABSTRACT

An image forming apparatus includes the following. An image carrier carries a toner image. A transfer unit transfers a toner image held by the image carrier onto a sheet. A controller controls a relation of a position between the image carrier and the sheet so that the sheet continues to come into contact with the image carrier from a position where a distance from a transfer nip is within a predetermined range when the sheet enters the transfer nip during an image forming job. The transfer nip is formed by the image carrier and the transfer unit.

12 Claims, 11 Drawing Sheets

| | DISTANCE FROM SECONDARY TRANSFER NIP TO CONTACT START POSITION [mm] | | | | | | | | |
|---|---|---|---|---|---|---|---|---|---|
| SHEET TYPE | 3 | 4 | 5 | 6 | 7 | 8 | 9 | 10 | 11 |
| 160 gsm YUPO SHEET | ×DISCHARGE | ×DISCHARGE | ×DISCHARGE | ○ | ○ | ○ | ○ | ○ | ×DISPLACEMENT |
| 260 gsm COATED SHEET | ×DISCHARGE | ○ | ○ | ○ | ○ | ○ | ×DISPLACEMENT | ×DISPLACEMENT | ×DISPLACEMENT |

○:NO NOISE
×DISCHARGE:ELECTRIC DISCHARGE NOISE OCCUR
×DISPLACEMENT:IMAGE DISPLACEMENT OCCUR

IMAGE FORMING APPARATUS AND CONTROL METHOD

BACKGROUND

Technological Field

The present invention relates to an image forming apparatus and a control method.

Description of the Related Art

Conventionally, there is a well-known image forming apparatus which transfers a toner image formed on a photoreceptor onto an intermediate transfer belt as an intermediate image carrier, transfers the toner image transferred on the intermediate transfer belt onto a sheet with a transfer nip, and fixes the toner image with a fixing device.

In such image forming apparatus, depending on the curled state of the sheet, the position that the sheet starts to come into contact with the intermediate transfer belt changes. For example, if the curled direction of the sheet is convex upward, the sheet and the intermediate transfer belt start to come into contact in a position far from the transfer nip as the curled amount becomes larger (see FIG. 8A), and the sheet and the intermediate transfer belt start to come into contact in a position close to the transfer nip as the curled amount becomes smaller (see FIG. 8B).

When the contact start position of the sheet and the intermediate transfer belt becomes too close to the transfer nip, electric discharge noise occurs near the transfer nip. When the contact start position of the sheet and the intermediate transfer belt becomes too far from the transfer nip, image displacement occurs due to the difference in speed between the intermediate transfer belt and the sheet.

For example, Japanese Patent Application Laid-Open Publication No. 2014-182153 describes a technique which includes at least one of a basis weight detector which detects a basis weight of the sheet to stabilize the posture of the front end of the recording material entering the transfer region regardless of the state of the recording material and a curled amount detector which detects the curled amount of the front end of the sheet. The transfer entrance guiding plate which guides the sheet while controlling the posture from below is provided in the entrance of the transfer region and such transfer entrance guiding plate changes the inclination angle based on the detected result of the provided detector.

However, Japanese Patent Application Laid-Open Publication No. 2014-182153 only considers the posture of the front end of the sheet. Therefore, this cannot suppress the problems such as electric discharge noise and image displacement throughout the entire sheet.

SUMMARY

An object of the present invention is to suppress throughout the entire sheet problems which occur due to the relation of the position between the image carrier and the sheet.

To achieve at least one of the above-mentioned objects, according to an aspect of the present invention, an image forming apparatus according to one aspect of the present invention includes, an image carrier which carries a toner image; a transfer unit which transfers a toner image held by the image carrier onto a sheet; and a controller which controls a relation of a position between the image carrier and the sheet so that the sheet continues to come into contact with the image carrier from a position where a distance from a transfer nip is within a predetermined range when the sheet enters the transfer nip during an image forming job, the transfer nip formed by the image carrier and the transfer unit.

According to another aspect of the present invention a control method for an image forming apparatus including an image carrier which carries a toner image, and a transfer unit which transfers a toner image held by the image carrier onto a sheet includes controlling a relation of a position between the image carrier and the sheet so that the sheet continues to come into contact with the image carrier from a position where a distance from a transfer nip is within a predetermined range when the sheet enters the transfer nip during an image forming job, the transfer nip formed by the image carrier and the transfer unit.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Hereinafter, one or more embodiments of the image forming apparatus, and the control method according to the present invention will be described with reference to the drawings. However, the scope of the invention is not limited to the disclosed embodiments.

First Embodiment

Figure 1:
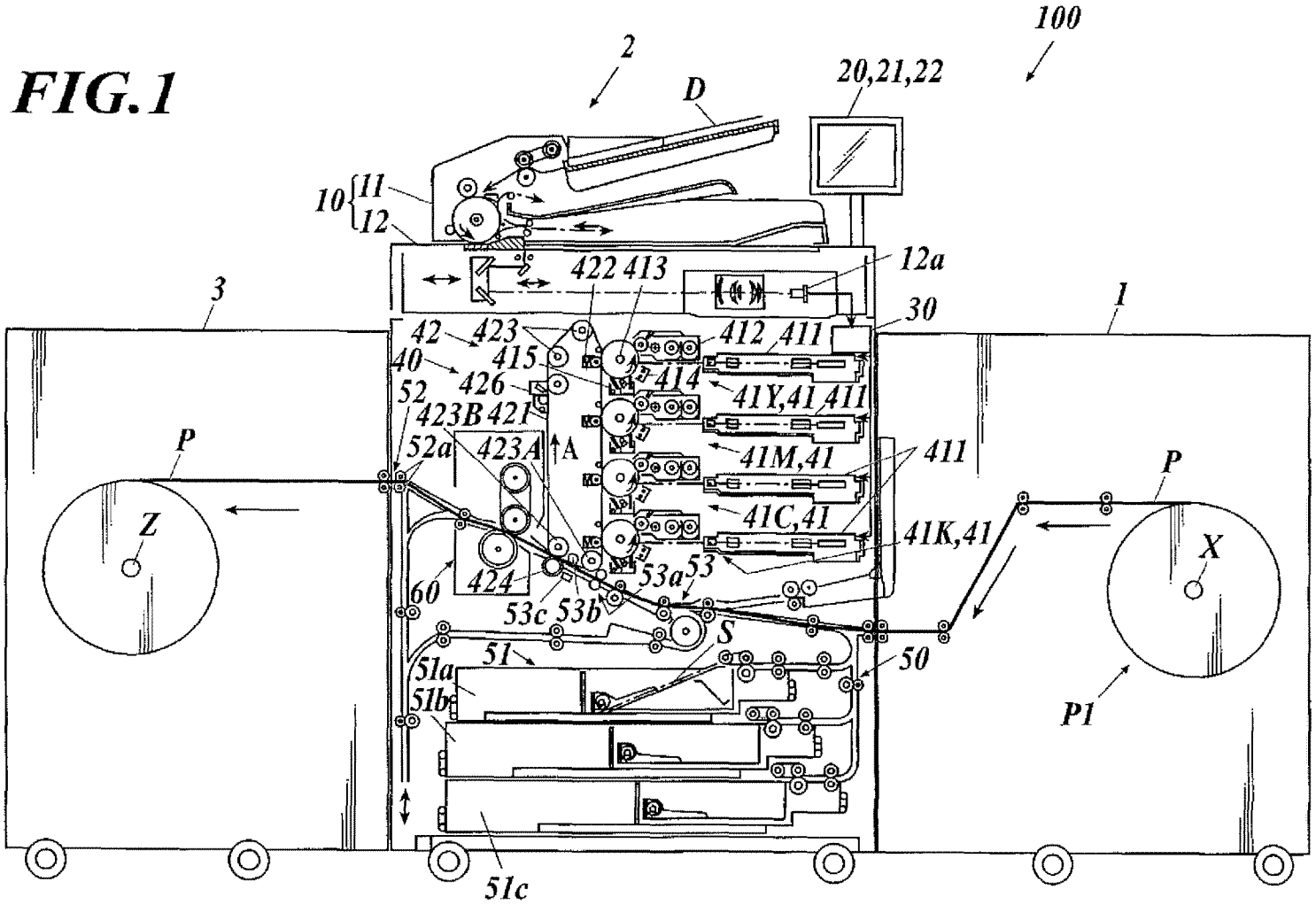
FIG. 1 is a diagram showing an example of an entire configuration of an image forming system according to a first embodiment.
Figure 2:
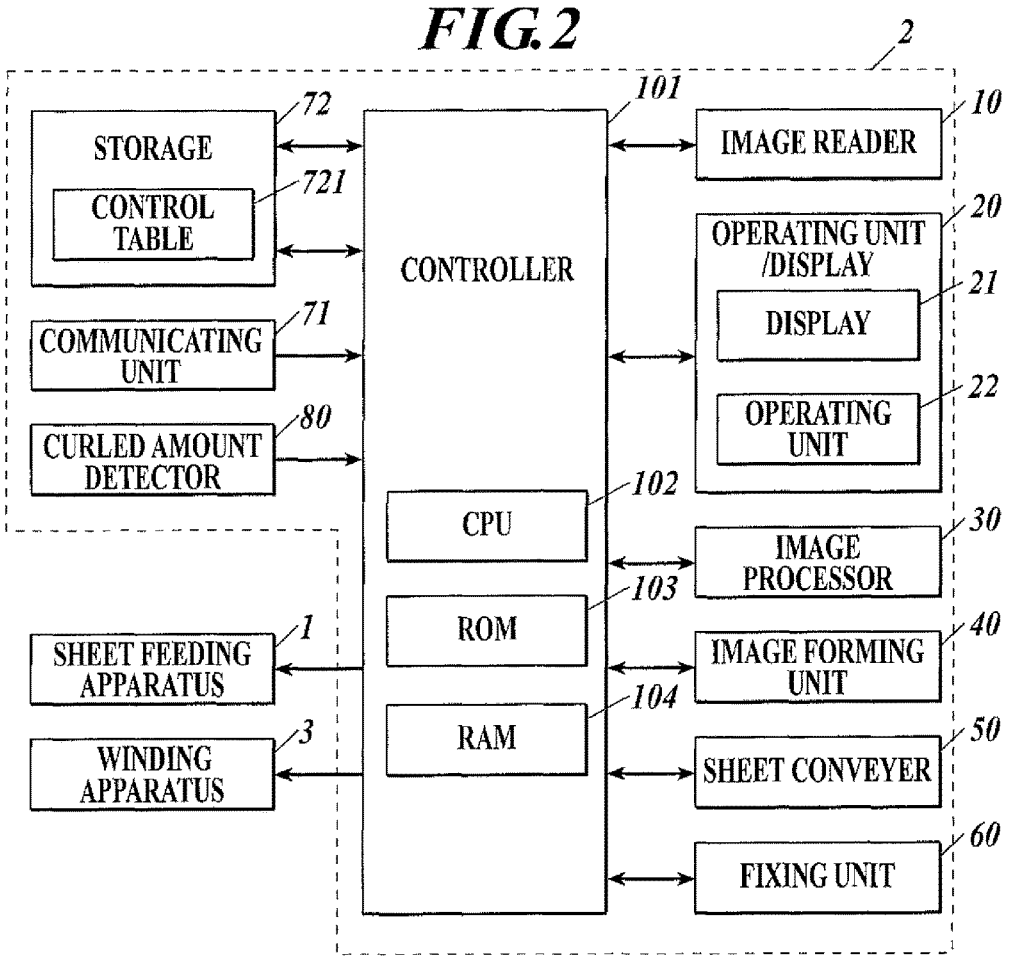
FIG. 2 is a diagram showing a main configuration of a control system in an image forming apparatus according to the first embodiment.

FIG. 1 is a diagram showing an entire configuration of an image forming system 100 according to a first embodiment. FIG. 2 is a diagram showing a main section of a control system of an image forming apparatus 2 provided in the image forming system 100 according to the first embodiment. The image forming system 100 is a system which uses a roll-type continuous sheet (sheet P) or sheets of paper (sheet S) shown with a bold line in FIG. 1, and forms an image on the sheet P or sheet S.

As shown in FIG. 1, the image forming system 100 includes a sheet feeding apparatus 1, an image forming apparatus 2 and a winding apparatus 3 which are connected from an upstream side along a conveying direction of the sheet P (hereinafter referred to as "sheet conveying direction"). The sheet feeding apparatus 1 and the winding apparatus 3 are used when the image is formed on the sheet P.

The sheet feeding apparatus 1 is an apparatus which feeds the sheet P to the image forming apparatus 2. As shown in FIG. 1, a roll P1 which rolls the sheet P around a supporting axis X is held rotatably in a housing of the sheet feeding apparatus 1. The sheet feeding apparatus 1 conveys the sheet P rolled around the supporting axis X to the image forming apparatus 2 at a certain speed using a plurality of pairs of conveying rollers such as a pushout roller, sheet feeding roller or the like. The sheet feeding operation of the sheet feeding apparatus 1 is controlled by the controller 101 provided in the image forming apparatus 2.

The image forming apparatus 2 is a color image forming apparatus of an intermediate transfer method which uses an electrophotography process technique. That is, the image forming apparatus 2 performs primary transfer to transfer the toner image of each color of Y (yellow), M (magenta), C (cyan), and K (black) formed on the photoreceptor drum 413 onto the intermediate transfer belt 421, and after the toner images with 4 colors are overlapped on the intermediate transfer belt 421, secondary transfer is performed to form the image on the sheet P fed from the sheet feeding apparatus 1 or the sheet S sent from the sheet feeding tray units 51*a* to 51*c*.

As shown in FIG. 2, the image forming apparatus 2 includes, an image reader 10, an operating unit/display 20, an image processor 30, an image forming unit 40, a sheet conveyor 50, a fixing unit 60, a communicating unit 71, a storage 72, a curl amount detector 80, and a controller 101.

The controller 101 includes a CPU (Central Processing Unit) 102, a ROM (Read Only Memory) 103, a RAM (Random Access Memory) 104, etc. The CPU 102 reads out a program according to a process to be performed from the ROM 103, deploys the program in the RAM 104, and centrally controls the operation of each block of the image forming apparatus 2, the sheet feeding apparatus 1, and the winding apparatus 3 in coordination with the deployed program. Here, various data stored in the storage 72 is referred. The storage 72 includes, for example, a nonvolatile semiconductor memory (flash memory) or a hard disk drive.

The controller 101 transmits mid receives various data between external apparatuses (for example, personal computers) connected to a communication network such as a LAN (Local Area Network), WAN (Wide Area Network), etc. through a communicating unit 71. For example, the controller 101 receives image data transmitted from an external apparatus and forms an image on the sheet P or the sheet S based on the image data (input image data). The communicating unit 71 includes a communication control card such as a LAN card, etc.

The image reader 10 includes an automatic document feeder (ADF) 11 and a document image scanning apparatus 12 (scanner).

The automatic document feeder 11 conveys a document D placed on a document tray using a conveying mechanism and sends the document D to the document image scanning apparatus 12. The automatic document feeder 11 is able to successively read at once images (on both faces) of a large number of sheets of the document D placed on the document tray.

The document image scanning apparatus 12 optically scans the document conveyed on the contact glass from the automatic document feeder 11 or a document placed on a contact glass. Then, the document image scanning apparatus 12 images light reflected from the document on a light receiving surface of a CCD (charge coupled device) sensor 12*a* and reads the document image. The image reader 10 generates input image data based on a result read by the document image scanning apparatus 12. The image processor 30 performs a predetermined image process on the input image data.

The operating unit/display 20 includes, for example, a liquid crystal display (LCD) with a touch panel, and functions as a display 21 and an operating unit 22.

The display 21 displays various operation screens, the state of the image, the state of operation of each function, and the like according to a display control signal input from the controller 101.

The operating unit 22 includes various operation keys such as numeric keys, start key, etc. The operating unit 22 receives various input operations by the user to output the operation signal to the controller 101.

The image processor 30 includes a circuit which performs digital image processes on the input image data according to initial setting or setting by the user. For example, the image processor 30 performs gradation correction based on gradation correction data (gradation correction table) under the control of the controller 101. In addition to gradation correction, the image processor 30 performs on the input image data various correction processes such as color correction, shading correction, etc., a compression process, and the like. The image forming unit 40 is controlled based on the image data on which the above processes are performed.

The image forming unit 40 includes image forming units 41Y, 41M, 41C, and 41K to form an image with color toner including a Y component, M component, C component, and K component based on the input image data and an intermediate transfer unit 42.

The image forming units 41Y, 41M, 41C, and 41K for the Y component, M component, C component and K component each include a similar configuration. For the purpose of description and illustration, common elements are shown with the same reference numerals, and Y M, C or K are added to the reference numerals when there is a need for discrimination. In FIG. 1, the reference numerals are added to only the elements of the image forming unit 41Y for the Y component, and the reference numerals for the elements included in the other image forming units 41M, 41C, and 41K are omitted.

The image forming unit 41 includes an exposing apparatus 411, a developing apparatus 412, a photoreceptor drum 413, a charging apparatus 414, and a drum cleaning apparatus 415.

For example, the photoreceptor drum 413 is a negative charge organic photoreceptor (OPC) and includes an under coat layer (UCL), a charge generation layer (CGL), and a charge transport layer (CTL) sequentially layered on a surface of a conductive cylinder made from aluminum (aluminum element tube). The charge generation layer includes an organic semiconductor in which charge generation material (for example, phthalocyanine pigment) is dispersed in a resin binder (for example, polycarbonate), and generates a pair of positive charge and negative charge by exposure from the exposing apparatus 411. The charge transport layer disperses a positive hole transport material (electron donating nitrogen compound) in the resin binder (for example, polycarbonate resin), and transports the positive charge generated in the charge generation layer to the surface of the charge transport layer.

The charging apparatus 414 charges the entire surface of the photoreceptor drum 413 including photoconductivity to a negative polarity. The exposure apparatus 411 includes, for example, a semiconductor laser and emits the laser corresponding to the image of each color component on the photoreceptor drum 413. The positive charge occurs in the charge generation layer of the photoreceptor drum 413 and the positive charge is transported to the surface of the charge transport layer. With this, the surface charge (negative charge) on the photoreceptor drum 413 is neutralized. Electrostatic latent images of each color component are formed on the surface of the photoreceptor drum 413 by the potential difference from the surroundings.

The developing apparatus 412 is a developing apparatus of a two component developing method, and applies toner of each color component on the surface of the photoreceptor drum 413 and visualizes the electrostatic latent image to form the toner image.

The drum cleaning apparatus 415 includes a drum cleaning blade which slides against the surface of the photoreceptor drum 413 and removes the transfer residual toner remaining on the surface of the photoreceptor drum 413 after primary transfer.

The intermediate transfer unit 42 includes an intermediate transfer belt 421 as an image carrier, a primary transfer roller 422, a plurality of supporting rollers 423, a secondary transfer roller 424, a belt cleaning apparatus 426, and the like. The secondary transfer roller 424 corresponds to the transfer unit of the present invention.

The intermediate transfer belt 421 is an endless belt and hangs in a loop around the plurality of supporting rollers 423. At least one of the plurality of supporting rollers 423 is a driving roller, and the others are following rollers. For example, preferably, the roller 423A provided downstream of the primary transfer roller 422 for the K component in the belt running direction is to be the driving roller. With this, it is possible to maintain the running speed of the intermediate transfer belt 421 in the primary transfer unit at a constant speed. The intermediate transfer belt 421 runs at a certain speed in the direction of the arrow A according to die rotation of the driving roller 423A.

The primary transfer roller 422 is positioned on the inner side of the intermediate transfer belt 421 facing the photoreceptor drums 413 of each color component. The primary transfer roller 422 is pressed against the photoreceptor drum 413 with the intermediate transfer belt 421 in between. With this, the primary transfer nip is formed to transfer the toner image from the photoreceptor transfer drum 413 to the intermediate transfer belt 421.

The secondary transfer roller 424 is provided on the outer side of the intermediate transfer belt 421 facing a backup roller 423 positioned downstream of the driving roller 423A in the belt running direction. The secondary transfer roller 424 is pressed against the backup roller 423B with the intermediate transfer belt 421 in between and a secondary transfer nip is formed to transfer the toner image from the intermediate transfer belt 421 to the sheet P or the sheet S. A belt type secondary transfer unit can be employed in which instead of the secondary transfer roller 424, a secondary transfer belt hangs in a loop around the plurality of supporting rollers including the secondary transfer roller 424.

When the primary transfer nip passes the intermediate transfer belt 421, the toner images on the photoreceptor drum 413 are overlapped sequentially on the intermediate transfer belt 421 to perform primary transfer. Specifically, a primary transfer bias is applied to the primary transfer roller 422 and the charge with polarity opposite of the toner is applied to the rear side of the intermediate transfer belt 421, that is, the side which comes into contact with the primary transfer roller 422. With this, the toner image is electrostatically transferred to the intermediate transfer belt 421.

Then, when the sheet P or the sheet S passes the secondary transfer nip, the toner image on the intermediate transfer belt 421 is transferred on the sheet P or the sheet S and secondary transfer is performed. Specifically, the secondary transfer bias is applied to the secondary transfer roller 424, and the charge with polarity opposite of the toner is applied to the rear side of the sheet P or the sheet S, that is, the side which comes into contact with the secondary transfer roller 424. With this, the toner image is electrostatically transferred to the sheet P or the sheet S. The sheet P or the sheet S on which the toner image is transferred is conveyed to the fixing unit 60.

The belt cleaning apparatus 426 removes the transfer residual toner remaining on the surface of the intermediate transfer belt 421 after the secondary transfer.

After secondary transfer of the toner image, the fixing unit 60 applies heat and pressure to the conveyed sheet P or the sheet S with the fixing nip to fix the toner image on the sheet P or the sheet S.

The sheet conveyor 50 includes a sheet feeder 51, a sheet ejector 52, a conveying path 53, and the like. The sheet feeder 51 includes 3 sheet feeding tray units 51*a* to 51*c* which store the sheets S (standard sheet, special sheet) discriminated based on basis weight and size according to type set in advance. The conveying path 53 includes a plurality of pairs of conveying rollers.

The sheets S stored in the sheet feeding tray units 51*a* to 51*c* are sent out one by one from the top and conveyed to the image forming unit 40 by the conveying path 53. In the image forming unit 40, the toner images on the intermediate transfer belt 421 are collectively transferred on one face of the sheet S to perform secondary transfer, fixing is performed in the fixing unit 60, and the sheet S is ejected. The sheet P fed from the sheet feeding apparatus 1 to the image forming apparatus 2 is conveyed to the image forming unit 40 by the conveying path 53 while applying tension. Then, in the image forming unit 40, the toner images on the intermediate transfer belt 421 are collectively transferred on one face of the sheet P to perform secondary transfer, and fixing is performed in the fixing unit 60. The sheet P on which the image is formed is conveyed to the winding apparatus 3 by the sheet ejector 52 including the pair of conveying rollers (pair of sheet ejecting rollers) 52*a*.

Figure 3:
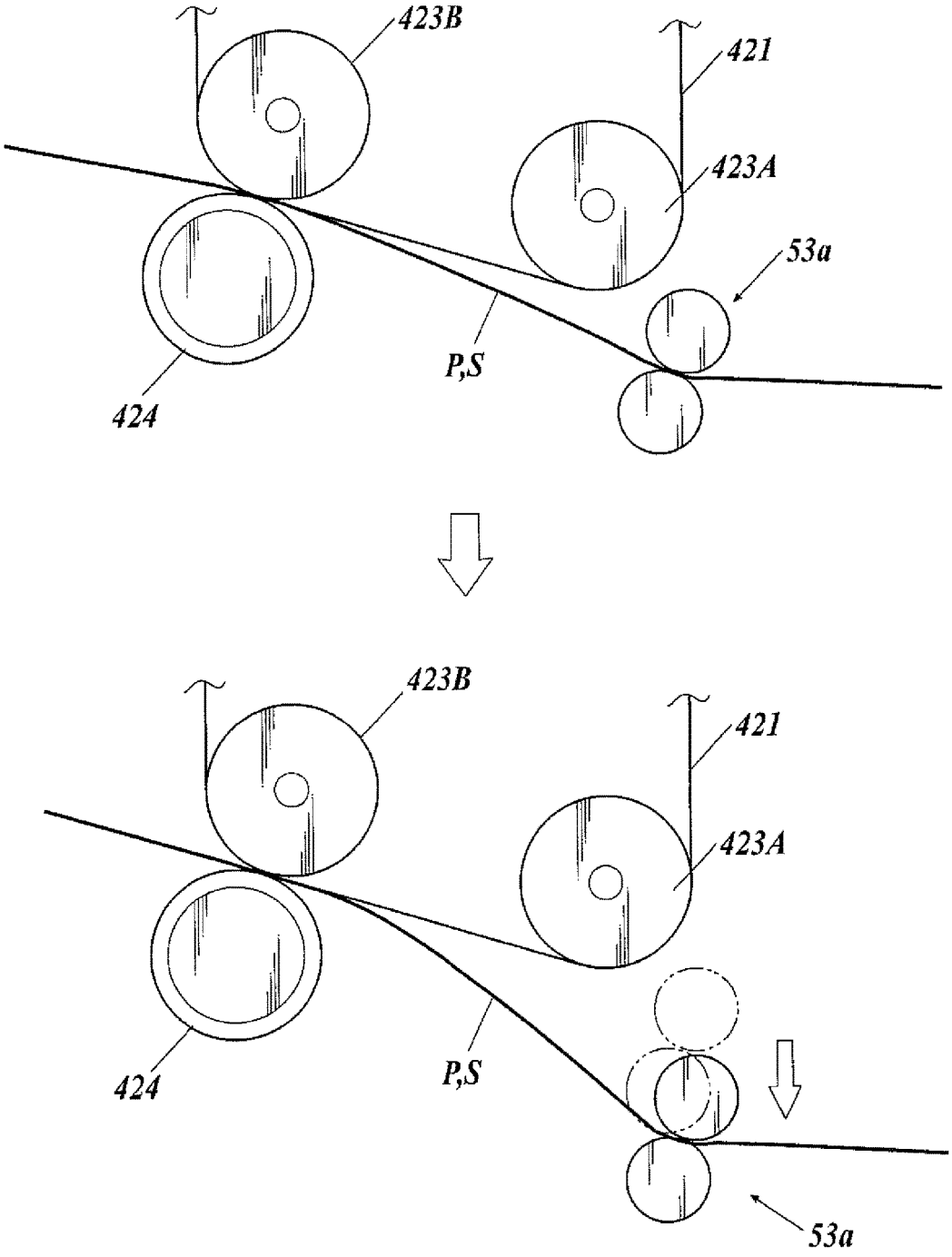
FIG. 3 is a diagram schematically showing control of a contact position of a sheet and a belt according to movement of a sheet passing guide member.

In the conveying path 53, a sheet passing guide member 53*a* is provided near the entrance to the secondary transfer nip to guide the sheet P or the sheet S to the secondary transfer nip. A sheet passing guide member 53*a* is able to move in an up and down direction as shown in FIG. 3. The sheet passing guide member 53*a* is moved with a driving source (not shown) and the posture of the sheet P or the sheet S entering the secondary transfer nip is controlled so that it is possible to control the position where the sheet P or the sheet S starts to come into contact with the intermediate transfer belt 421. Once contact is made, the sheet P or the sheet S and the intermediate transfer belt 421 continue contact with each other until these reach the secondary transfer nip. According to the present embodiment, the sheet passing guide member 53*a* is used to control the position where the sheet P and the intermediate transfer belt 421 start to come into contact.

Figure 4:
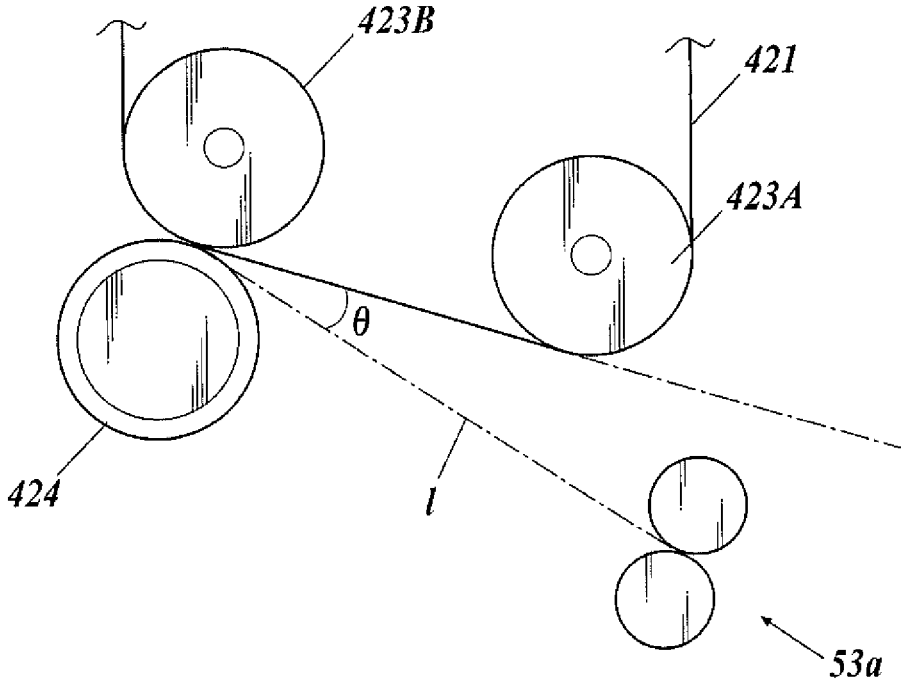
FIG. 4 is a diagram describing a position defining angle of a sheet passing guide member.

As shown in FIG. 4, the position of the sheet passing guide member 53*a* is determined by an angle θ (position defining angle θ) between a line 1 connecting the nip of the sheet passing guide member 53*a* with the secondary transfer nip and the intermediate transfer belt 421. The distance of the contact start position between the sheet P or the sheet S and the intermediate transfer belt 421 becomes farthest from the secondary transfer nip when the position defining angle θ is 0°. As the angle θ becomes larger, the distance of the contact start positon between the sheet P and the intermediate transfer belt 421 becomes closer from the secondary transfer nip.

The sheet passing guide member 53*a* nips the sheet P, and preferably includes rollers to reduce the burden on the paper. Since tension is applied to the sheet P in the conveying path 53, the sheet passing guide member 53*a* is able to control the posture of the sheet P by only either one of the rear face or the front face of the sheet P.

Figure 5:
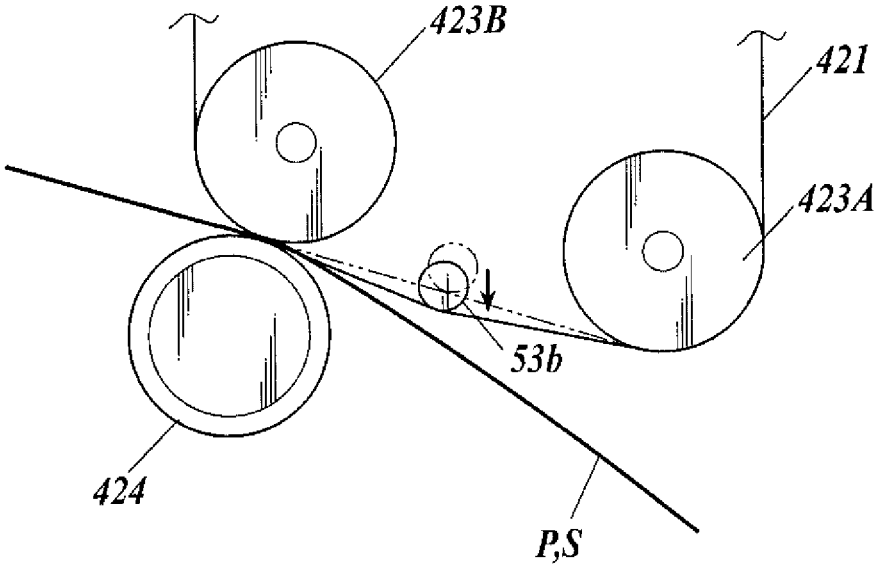
FIG. 5 is a diagram schematically showing control of the contact position of the sheet and the belt due to pushing of a belt contact roller.

As shown in FIG. 5, a belt contact roller 53*b* as a belt contact member is provided in a position on an inner side (inner surface side) of the intermediate transfer belt 421 facing the conveying path 53 with the intermediate transfer belt 421 in between. The belt contact roller 53*b* is able to move in the inner direction and the outer direction of the intermediate transfer belt 421. The belt contact roller 53*b* is moved with a driving source (not shown) so that the contact start position between the sheet P or the sheet S entering the secondary transfer nip and the intermediate transfer belt 421 can be controlled. According to the present embodiment, the belt contact roller 53*b* is used for controlling the contact start position between the sheet S and the intermediate transfer belt 421 when the sheet passing guide member 53*a* cannot be used for control in the rear end portion. As the belt contact roller 53*b* moves the intermediate transfer belt 421 in a direction pushing toward the outside (arrow direction shown in FIG. 5) (pushes the intermediate transfer belt 421 with the belt contact roller 53*b*), the distance from the contact start position of the sheet S and the intermediate transfer belt 421 to the secondary transfer nip becomes farther.

Figures 6, 7:
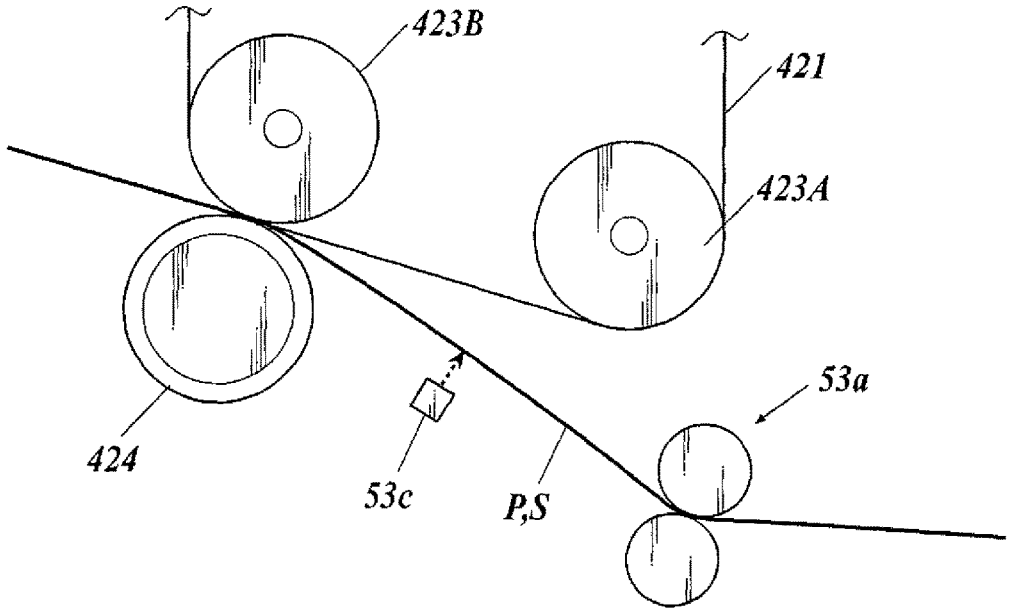
FIG. 6 is a diagram schematically showing measurement of a distance to the sheet measured by a distance sensor.
FIG. 7 is a diagram showing a result of an experiment testing whether electric discharge noise and image displacement occur when image forming is performed with the distance from a secondary transfer nip to a contact start position is changed using 160 gsm of yupo sheet or 260 gsm of coated sheet.

As shown in FIG. 6, a distance sensor 53*c* is provided on a conveying path of the conveying path 53 (upstream side of the secondary transfer nip). The distance sensor 53*c* measures the distance to the sheet P and the sheet S on the conveying path and outputs the result to the curled amount detector 80. The curled amount detector 80 detects the curled amount of the sheet P and the sheet S based on the distance measured by the distance sensor 53*c* and outputs the result to the controller 101.

The winding apparatus 3 is an apparatus which winds the sheet P conveyed from the image forming apparatus 2. For example, the sheet P is rolled around the supporting axis Z and held as a roll in the housing of the winding apparatus 3. Therefore, the winding apparatus 3 winds the sheet P conveyed from the image forming apparatus 2 through the plurality of pairs of conveying rollers (for example, pushout roller or sheet ejecting roller) around the supporting axis at a certain speed. The winding operation of the winding apparatus 3 is controlled by the controller 101 provided in the image forming apparatus 2.

Next, the operation of the image forming apparatus 2 is described.

Here, the range of the suitable distance from the secondary transfer nip to the contact start position between the sheet P or the sheet S and the intermediate transfer belt 421 (hereinafter simply referred to as the contact start position) is determined depending on the sheet type (type of sheet). For example, when the sheet is a sheet with high stiffness such as cardboard, image displacement easily occurs if the distance from the secondary transfer nip to the contact start position is far. Therefore, the suitable distance between the secondary transfer nip and the contact start position becomes closer as the stiffness of the sheet P or the sheet S becomes higher. For example, when the electric resistance of the sheet P or sheet S is high, charging occurs and the electric discharge noise easily occurs if the distance from the secondary transfer nip to the contact start position is near. Therefore, the suitable distance between the secondary transfer nip and the contact start position becomes far as the electric resistance of the sheet P or the sheet S becomes high.

FIG. 7 shows a result of an experiment verifying whether the electric discharge noise and the image displacement occurs when image forming is performed with the distance from the secondary transfer nip to the contact start position varied using 160 gsm of the Yupo sheet and 260 gsm of the coated sheet. As shown in FIG. 7, as for 160 gsm of the Yupo sheet with the high electric resistance, the range of the suitable distance between the secondary transfer nip and the contact start position is 6 mm to 10 mm. As for 260 gms of the coated sheet with high stiffness, the range of the suitable distance between the secondary transfer nip and the contact start position is 4 mm to 8 mm.

Figure 8A:
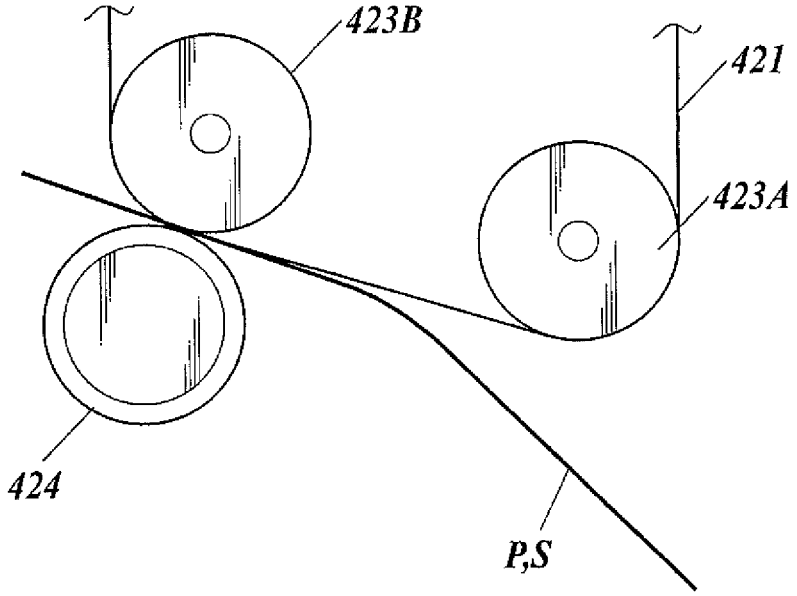
FIG. 8A is a diagram showing contact of a sheet and an intermediate transfer belt when a curled direction of the sheet is convex upward and a curled amount of the sheet is large.
Figure 8B:
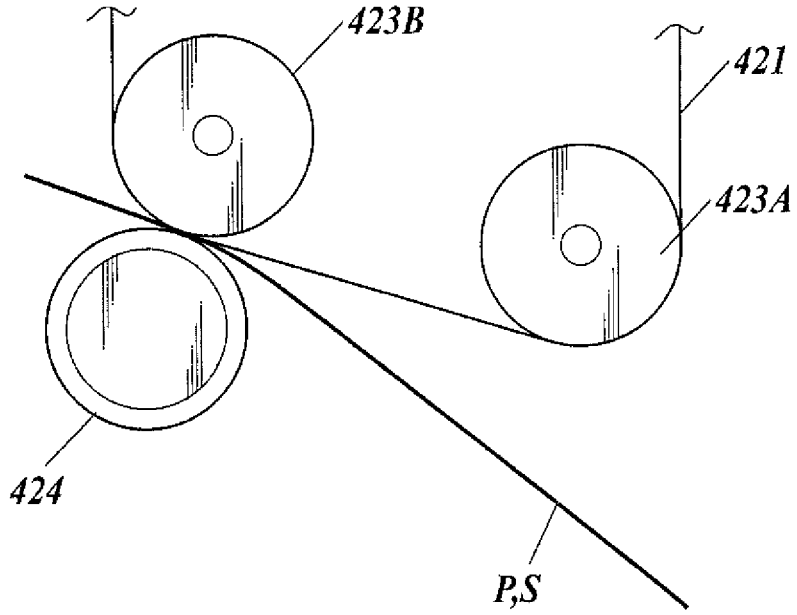
FIG. 8B is a diagram showing contact of a sheet and an intermediate transfer belt when the curled direction of the sheet is convex upward and the curled amount of the sheet is small.
Figure 9A:
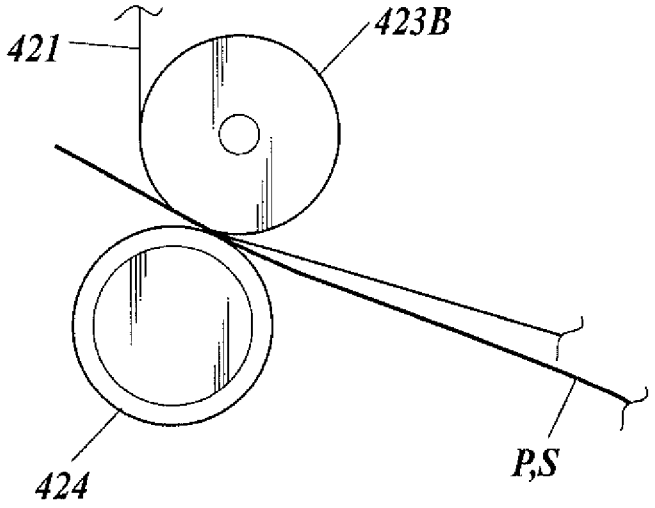
FIG. 9A is a diagram showing contact of a sheet and an intermediate transfer belt when the curled direction of the sheet is convex downward and the curled amount of the sheet is small.
Figure 9B:
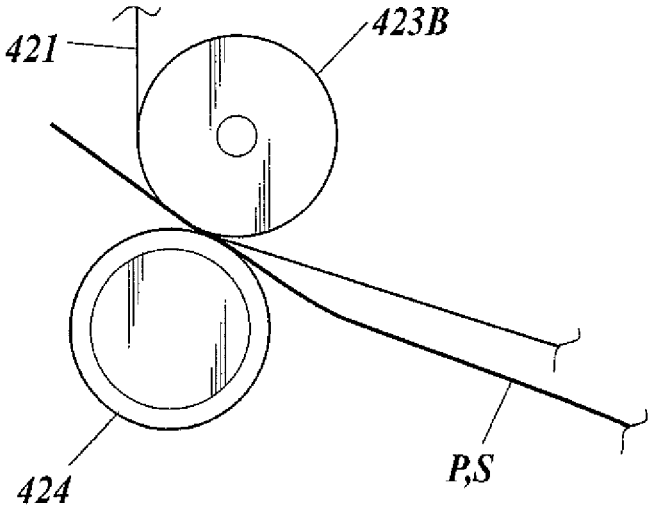
FIG. 9B is a diagram showing contact of a sheet and an intermediate transfer belt when the curled direction of the sheet is convex downward and the curled amount of the sheet is large.

However, the position where the sheet P or the sheet S starts to come into contact with the intermediate transfer belt 421 changes according to the curled amount of the sheet P or the sheet S to be used. For example, when the curled direction of the sheet P or the sheet S is convex upward, as shown in FIG. 8A, the sheet P or the sheet S and the intermediate transfer belt 421 start contact at a position far from the secondary transfer nip as the curled amount becomes larger. As shown in FIG. 8B, the sheet P or the sheet S and the intermediate transfer belt 421 start contact at a position close from the secondary transfer nip as the curled amount becomes small. When the curled direction of the sheet P or the sheet S is convex downward, as shown in FIG. 9A, the sheet P or the sheet S and the intermediate transfer belt 421 start contact at a position far from the secondary transfer nip as the curled amount becomes smaller. As shown in FIG. 9B, the sheet P or the sheet S and the intermediate transfer belt 421 start contact at a position close from the secondary transfer nip as the curled amount becomes larger. For example, the curled amount is always changing in the image forming job according to variation of the outer diameter of the roll P1. Therefore, the contact start position between the sheet P or the sheet S and the intermediate transfer belt 421 is always changing in the image forming job. When the contact start position is outside the suitable range, the electric discharge noise and the image displacement occurs.

Here, the image forming apparatus 2 performs the contact start position control process described below to control the relation of the positions of the intermediate transfer belt 421 and the sheet P or the sheet S so that the sheet P or the sheet S continues to come into contact with the intermediate transfer belt 421 at a distance from the secondary transfer nip within the suitable range during the image forming job.

Figure 10:
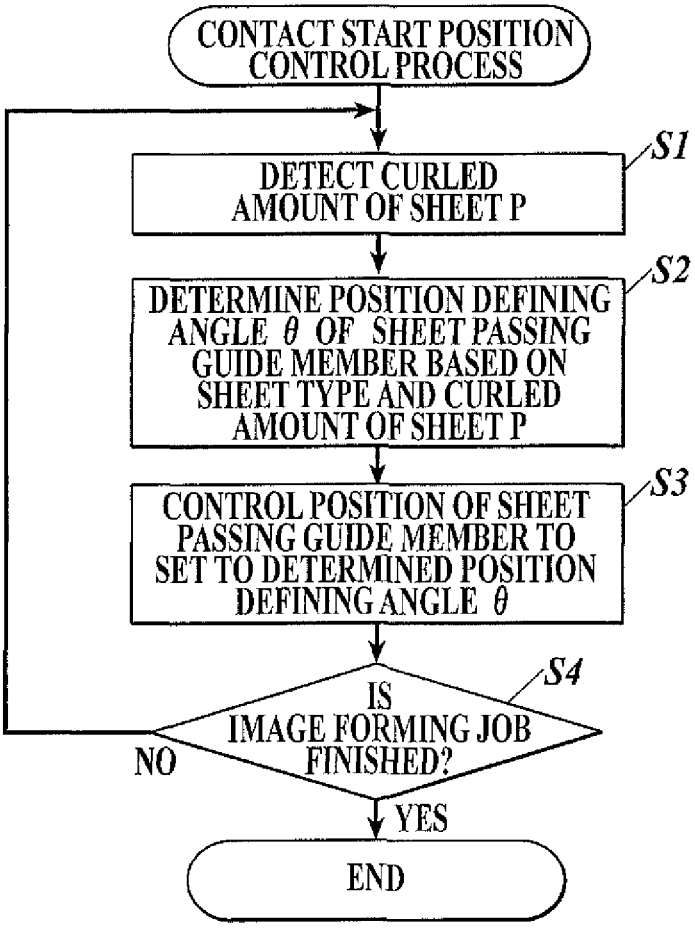
FIG. 10 is a flowchart showing a contact start position control process performed by a controller shown in FIG. 2.

FIG. 10 shows a flowchart of the contact start position control process performed by the controller 101. The contact start position control process is executed by the CPU of the controller 101 in coordination with the program stored in the ROM when the image forming job using the sheet P starts.

First, the controller 101 uses the curled amount detector 80 to detect the curled amount of the sheet P used in image forming (step S1).

Next, the controller 101 determines the position defining angle θ of the sheet passing guide member 53*a* based on the sheet type and the curled amount of the sheet P (step S2).

Figure 11:
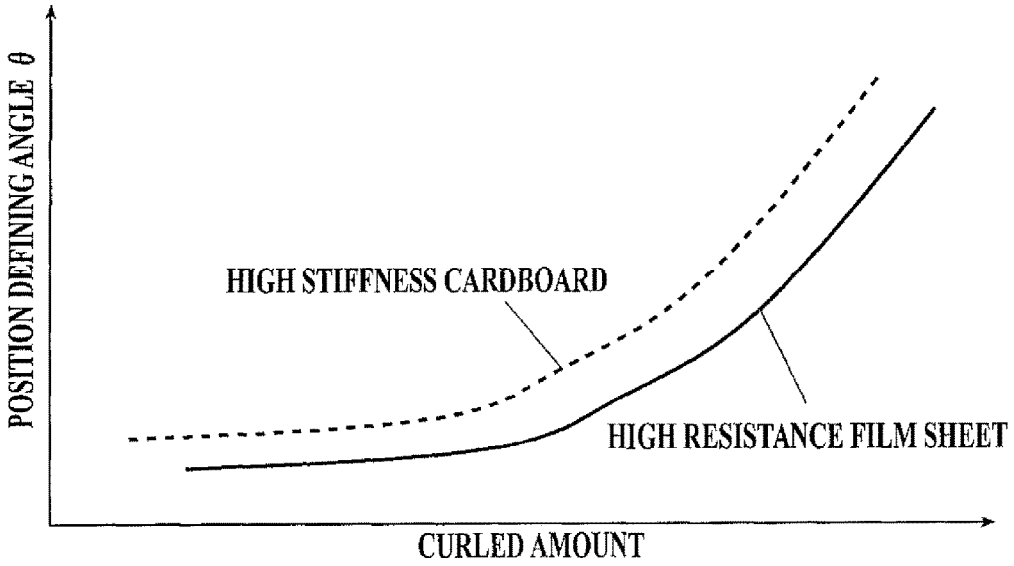
FIG. 11 is a diagram showing an example of a control table stored in a storage shown in FIG. 2.

Here, as shown in FIG. 11, the storage 72 stores the control table 721 corresponding for each sheet type the curled amount with the position defining angle θ of the sheet passing guide member 53*a* so that the distance from the secondary transfer nip to the contact start position between the sheet and the intermediate transfer belt 421 is within a predetermined range (within the suitable range that noise and image displacement does not occur) for that curled amount. The control table 721 is a table obtained by experiments. FIG. 11 shows when the curled direction is convex upward. According to the present embodiment, the curled direction of the sheet P is convex upward according to the configuration of the sheet feeding apparatus 1 shown in FIG. 1. The controller 101 refers to the control table 721 and determines the position defining angle θ according to the sheet type and the detected curled amount of the sheet P used in the image forming.

Next, the controller 101 controls the position of the sheet passing guide member 53*a* to obtain the determined position defining angle θ (step S3).

Next, the controller 101 determines whether the image forming job ends (step S4). When it is determined that the image forming job is not finished (step S4; NO), the controller 101 returns the process to step S1. When it is determined that the image forming job ends (step S4; YES), the controller 101 ends the contact start position control process.

Here, the process of steps S1 to S3 can always be repeated or can be repeated at a predetermined interval within a range that the contact start position can be maintained at a suitable range.

As described above, during the image forming job, the controller 101 controls the position of the sheet passing guide member 53*a* so that the sheet P continues to come into contact with the intermediate transfer belt 421 from the position where the distance from the secondary transfer nip is within the suitable range. Therefore, it is possible to suppress problems such as electric discharge noise and image displacement caused throughout the entire sheet used in the image forming due to the relation of the positions of the sheet P and the intermediate transfer belt 421.

When the sheet used is the sheet S, since the sheet length is short, it is not possible to control the position of the rear end with the sheet passing guide member 53*a*. When the sheet used in the image forming job is the sheet S, the controller 101 controls the pushing amount of the belt contact roller 53*b* to the intermediate transfer belt 421 so that the sheet S continues to come into contact with the intermediate transfer belt 421 from the position where the distance from the secondary transfer nip is within the suitable range. Specifically, the storage 72 stores for each sheet type, the control table (not shown) corresponding the curled amount with the pushing amount (mm) of the belt contact roller 53*b* so that the distance from the secondary transfer nip to the contact start position between the sheet S and the intermediate transfer belt 421 is within the predetermined range (within the suitable range that noise and image displacement do not occur) for that curled amount. When the image forming job using the sheet S starts, the controller 101 repeats the following constantly or at an interval within a range that the contact start position can be maintained within a suitable range, specifically, detecting the curled amount using the curled amount detector 80, determining the pushing amount according to the sheet type of the sheet S and the detected curled amount by referring to the control table, and controlling the position of the belt contact roller 53*b* according to the determined pushing amount. With this, it is possible to suppress problems such as electric discharge noise and image displacement caused by the relation in the position between the sheet S and the intermediate transfer belt 421 throughout the entire sheet used in image forming.

Second Embodiment

Next, the second embodiment of the present invention is described.

Figure 12:
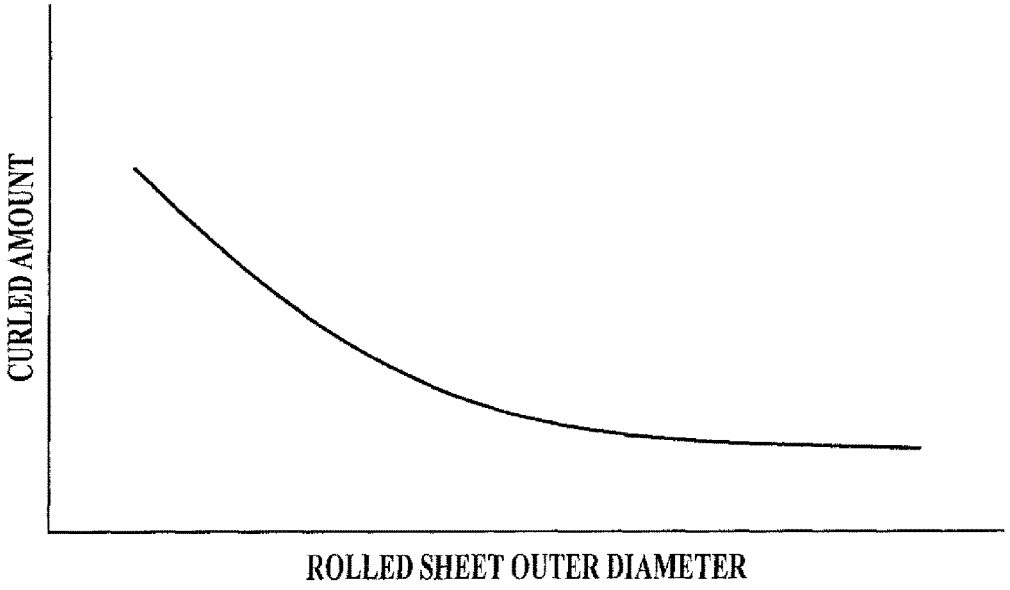
FIG. 12 is a diagram showing a relation between a roll outer diameter and a curled amount.

The sheet P rolled in a rolled shape has a smaller curled amount as the outer diameter becomes larger as shown in FIG. 12. According to the second embodiment, the outer diameter information of the roll of the sheet P is obtained, the curled amount is detected based on the obtained outer diameter information and the contact start position of the sheet P and the intermediate transfer belt 421 is controlled.

Figure 13:
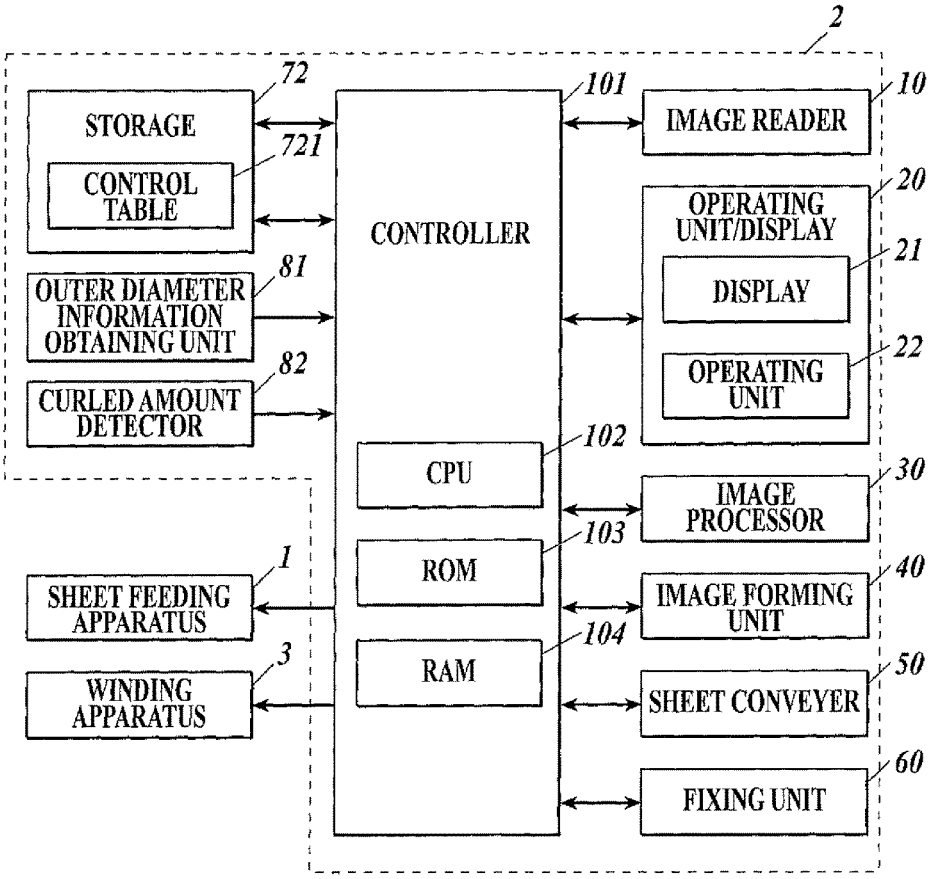
FIG. 13 is a diagram showing a main configuration of a control system in an image forming apparatus according to a second embodiment.

FIG. 13 is a diagram showing a main configuration of the control system in the image forming apparatus 2 according to the second embodiment. As shown in FIG. 13, the image forming apparatus 2 according to the second embodiment includes an outer diameter information obtaining unit 81 which obtains the outer diameter information of the roll of the sheet P.

For example, the outer diameter information obtaining unit 81 includes a displacement sensor and measures the distance from an upper edge to a lower edge of the roll P1 in order to directly detect the outer diameter information of the roll P1 in the sheet feeding apparatus 1.

The outer diameter information obtaining unit 81 may receive input regarding the outer diameter of the roll P1 in the initial state from the user through the operating unit 22. With this, the outer diameter information obtaining unit 81 may predict the information of the outer diameter of the roll P1 by the initial outer diameter and the number of rotations and the rotating time of the supporting axis X.

The outer diameter information obtaining unit 81 may detect the weight of the entire roll P1 by the supporting axis X and predict the information of the outer diameter of the roll P1 from the weight of the roll P1.

The curled amount detector 82 detects the curled amount of the sheet P based on the outer diameter information obtained by the outer diameter information obtaining unit 81. As shown in FIG. 12, the curled amount of the rolled sheet becomes smaller as the outer diameter becomes larger. The relation between the rolled sheet outer diameter and the curled amount is different depending on the sheet type. For example, the table showing the relation between the rolled sheet outer diameter and the curled amount as shown in FIG. 12 is stored in the storage 72. The curled amount detector 82 refers to the table of the storage 72 and detects the curled amount based on the outer diameter information obtained by the outer diameter information obtaining unit 81.

The roll P1 curls larger as the tension of the roll becomes higher. The curled amount detector 82 may correct the curled amount detected from the outer diameter information based on the roll tension information of the roll P1 input by the user on the operating unit 22. The roll tension information can be measured using, for example, a Schmidt hammer. With this, it is possible to detect the curled amount of the sheet P more accurately.

Depending on how the rolled sheet is stored, the amount of glue leaking out may vary, and the more the glue leaks out, the smaller the curled amount of the roll P1 becomes because the roll becomes loose. For example, when stored for a long period of time at a high temperature, the curled amount becomes small. The curled amount detector 82 may correct the curled amount detected from the outer diameter information based on the information showing the storage state input by the user on the operating unit 22 (for example, storage temperature, storage time, etc.). With this, it is possible to more accurately detect the curled amount of the sheet P.

The other configuration of the image forming apparatus 2 according to the second embodiment is similar to the description of the first embodiment, and the description is to be referred.

Moreover, the operation of the image forming apparatus 2 according to the second embodiment is the same as the steps described above with the exception of the detecting method of the curled amount being different from the description referring to FIG. 11. Therefore, the description of the operation is also to be referred.

The outer diameter of the roll P1 becomes smaller as more image forming is performed. That is, the curled amount increases. When the curled direction of the sheet P is convex upward, the controller 101 makes the position defining angle of the sheet passing guide member 53*a* larger as the time passes from when the image forming starts. When the curled direction is convex downward, the controller 101 makes the position defining angle of the sheet passing guide member 53*a* smaller as the time passes from when the image forming starts.

As described above, according to the second embodiment, the curled amount of the sheet P is detected using the outer diameter information of the sheet P. Based on the detected curled amount, the sheet passing guide member 53*a* is controlled so that the sheet P continues to come into contact with the intermediate transfer belt 421 from a position so that the distance from the secondary transfer nip is within a suitable range. Therefore, it is possible to suppress problems such as electric discharge noise and image displacement occurring throughout the entire sheet used in the image forming caused by the relation of the position between the sheet P and the intermediate transfer belt 421.

Modifications of the first embodiment and the second embodiment are described.

Modification 1

Figure 14:
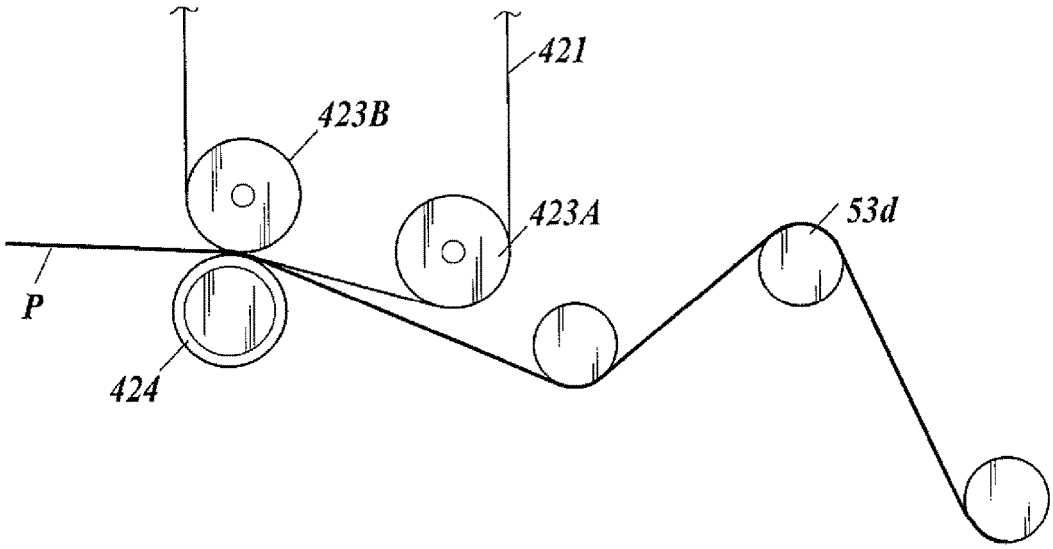
FIG. 14 is a diagram showing a hanging roller to control the contact position of the sheet and the belt.

According to the first embodiment and the second embodiment, the contact start position between the sheet P and the intermediate transfer belt 421 is controlled by changing the position defining angle θ of the sheet passing guide member 53*a* according to the curled amount. Alternatively, as shown in FIG. 14, a hanging roller 53*d* is provided as a tension adjuster upstream (before) of the secondary transfer roller 424, and the contact start position between the sheet P and the intermediate transfer belt 421 is controlled by moving the position of the hanging roller 53*d* up and down according to the curled amount to change the tension. When the hanging roller 53*d* is raised and the rolled amount of the sheet P is increased, the tension on the sheet P is increased. When the curled direction is convex upward, as the tension becomes higher, the sheet P and the intermediate transfer belt 421 start contact at a position near the secondary transfer nip. This becomes opposite when the curled direction is convex downward.

When the contact start position is controlled by the position of the hanging roller 53*d*, the storage 72 stores the control table corresponding for each sheet type the curled amount and the position information of the hanging roller 53*d* in which the distance from the secondary transfer nip to the contact start position between the sheet P and the intermediate transfer belt 421 is within a predetermined range (within a suitable range in which noise and image displacement do not occur) for that curled amount. When the image funning job using the sheet P starts, the controller 101 continues to repeat the following or repeats the following at an interval in which the contact start position is maintained in a suitable range, that is, detects the curled amount with the curled amount detector 80 (or the curled amount detector 82), determines the position of the hanging roller 53*d* according to the sheet type and the detected curled amount of the sheet P by referring to the control table and controls the tension on the sheet P by controlling the hanging roller 53*d* in the determined position. With this, it is possible to suppress throughout the entire sheet used in the image forming problems such as electric discharge noise and image displacement occurring by the relation of the position between the sheet. P and the intermediate transfer belt 421.

Modification 2

Figure 15:
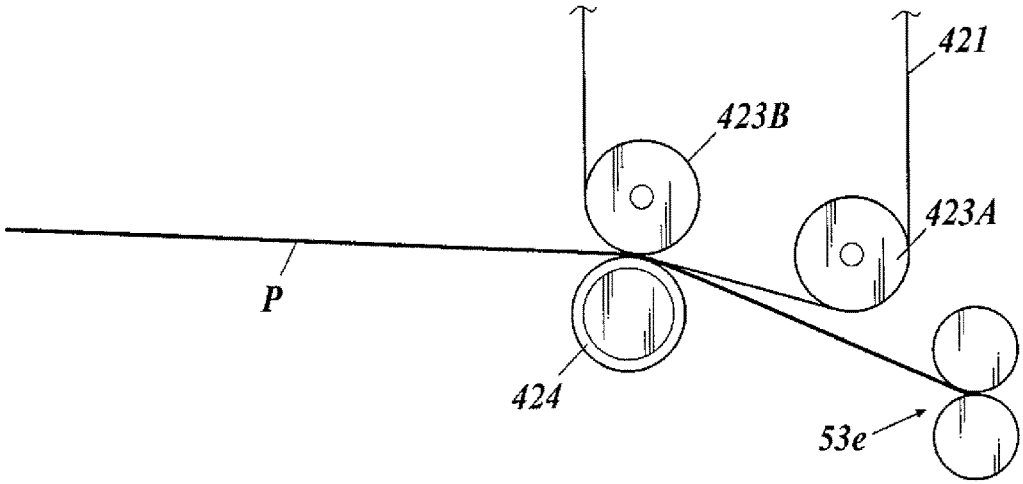
FIG. 15 is a diagram showing a driving roller to control the contact position of the sheet and the belt.

According to the first and second embodiment, the contact start position between the sheet P and the intermediate transfer belt 421 is controlled by changing the position defining angle θ of the sheet passing guide member 53*a* according to the curled amount. As shown in FIG. 15, the driving roller 53*e* is provided upstream (before) the secondary transfer roller 424 and according to the curled amount, the driving speed of the driving roller 53*e* is varied to control the contact start position between the sheet P and the intermediate transfer belt 421. When the driving speed of the driving roller 53*a* is reduced, the tension of the sheet P can be increased. When the curled direction is convex upward, the sheet P and the intermediate transfer belt 421 come into contact in a position close to the secondary transfer nip as the tension becomes higher. The opposite occurs when the curled direction is convex downward.

When the contact start position is controlled by the driving speed of the driving roller 53*e*, the storage 72 stores a control table corresponding for each sheet type the curled amount and the driving speed of the driving roller 53*e* in which the distance from the secondary transfer nip to the contact start position between the sheet P and the intermediate transfer belt 421 is within a predetermined range (within a suitable range in which noise and image displacement do not occur) for that curled amount. The controller 101 continues to repeat the following or repeats the following at an interval in which the contact start position is maintained in a suitable range, that is, detects the curled amount with the curled amount detector 80 (or the curled amount detector 82), determines the driving speed of the driving roller 53*e* according to the sheet type and the detected curled amount of the sheet P by referring to the control table and controls the tension on the sheet P by driving the driving roller 53*e* in the determined driving speed. With this, it is possible to suppress throughout the entire sheet used in the image forming problems such as electric discharge noise and image displacement occurring by the relation of the position between the sheet P and the intermediate transfer belt 421.

Modification 3

According to the first embodiment, the configuration includes a curled amount detector 80 which detects the curled amount of the sheet P or the sheet S based on the detecting result of the distance sensor 53*c*. Alternatively, the image forming apparatus 2 includes a contact start position detector (not shown) which detects a contact start position between the sheet P or the sheet S and the intermediate transfer belt 421 based on the measured result of the distance sensor 53*c*. For example, a plurality of distance sensors 53*c* may be provided on the conveying path and the contact start position detector detects the contact start position between the sheet P or the sheet S and the intermediate transfer belt 421 based on the distance to the sheet P or the sheet S measured by each distance sensor 53*c*. Based on the contact start position detected by the contact start position detector, the controller 101 may control the position defining angle θ of the sheet passing guide member 53*a*, the position of the hanging roller 53*d* or the driving speed of the driving roller 53*e* so that the distance from the secondary transfer nip to the contact start position becomes a suitable range predetermined for each sheet type.

As described above, according to the controller 101 of the image forming apparatus 2, when the sheet P or the sheet S enters the secondary transfer nip during the image forming job, the controller 101 controls the relation of the position between the intermediate transfer belt 421 and the sheet P or the sheet S so that the sheet P or the sheet S continues to contact with the intermediate transfer belt 421 from the position in which the distance from the secondary transfer nip is in a predetermined range.

Therefore, it is possible to suppress throughout the entire sheet used in the image forming problems such as electric discharge noise and image displacement occurring by the relation of the position between the sheet P or the sheet S and the intermediate transfer belt 421.

For example, the controller 101 controls the relation of the position between the intermediate transfer belt 421 and the sheet P or the sheet S so that the sheet P or the sheet S continues to be in contact with the intermediate transfer belt 421 from the position where the distance from the secondary nip is in a predetermined range even when the curled amount of the sheet P or the sheet S detected by the curled amount detector changes. Therefore, even if the curled amount changes during the image forming, it is possible to suppress problems such as electric discharge noise and image displacement.

For example, when an image is formed on the sheet P which is a roll type continuous sheet, the curled amount detector detects the curled amount of the sheet P based on the outer diameter information of the sheet P. Therefore, the curled amount can be detected from the outer diameter of the sheet P.

The controller 101 changes the position where the sheet starts to come into contact with the intermediate transfer belt 421 according to the sheet type. Therefore, it is possible to suitably suppress problems such as electric discharge noise and image displacement according to the used type of sheet P or the sheet S.

The description of the above-described embodiments show preferable examples of the image forming apparatus of the present invention, and the present invention is not limited to the above.

For example, according to the second embodiment, a control table showing the relation between the curled amount and the position defining angle θ is stored in the storage 72, and the position defining angle θ is determined by referring to the control table. Alternatively, as shown in FIG. 12, since the curled amount can be predicted from the outer diameter information, a control table showing the relation between the outer diameter information and the position defining angle θ can be made based on the relation between the relation of the outer diameter information and the curled amount and the relation of the curled amount and the position defining angle θ. The control table can be stored in the storage 72, and the position defining angle θ can be determined by referring to the control table.

The above-described description discloses using a ROM, a nonvolatile memory, or a hard-disk as the computer readable medium including the program of the present invention, but the present invention is not limited to the above. As other computer readable mediums, a portable recording medium such as a CD-ROM can be applied. A carrier wave can be applied as the medium providing data of the program of the present invention through communication lines.

The detailed configuration and the detailed operation of the image forming apparatus can be suitably changed without leaving the scope of the present invention.

Although embodiments of the present invention have been described and illustrated in detail, it is clearly understood that the same is by way of illustration and example only and not limitation, the scope of the present invention should be interpreted by terms of the appended claims.

Japanese Patent Application No. 2016-175118 filed on Sep. 8, 2016 including description, claims, drawings, and abstract, the entire disclosure is incorporated herein by reference in its entirety.

What is claimed is:

1. An image forming apparatus comprising:

an image carrier configured to carry a toner image;

a transfer unit, the image carrier and the transfer unit forming a transfer nip for receiving a sheet, the transfer unit configured to transfer onto the sheet the toner image carried by the image carrier when the sheet enters the transfer nip after contacting the image carrier at a contact start position on the image carrier that is at a distance upstream from the transfer nip;

a curled amount detector configured to detect a curled amount of the sheet upstream of the transfer nip, wherein the sheet is a roll-type continuous sheet that is conveyed toward the image carrier from a roll, the curled amount detector detects the curled amount of the sheet based on an outer diameter of the roll; and a controller which controls a positional relationship between the image carrier and the sheet so that the distance is within a predetermined range when the sheet enters the transfer nip during an image forming job, and the distance is within the predetermined range as the detected curled amount changes.

2. The image forming apparatus according to claim 1, further comprising a contact start position detector which detects the contact start position of the sheet on the image carrier, wherein, the controller further controls the positional relationship between the image carrier and the sheet based on the detected contact start position.

3. The image forming apparatus according to claim 1, wherein the controller changes the contact start position according to a type of the sheet.

4. The image forming apparatus according to claim 1, further comprising a sheet passing guide member which is provided upstream of the transfer nip to guide the sheet to the transfer nip, wherein the controller controls the positional relationship between the image carrier and the sheet by changing a posture of the sheet with the sheet passing guide member.

5. The image forming apparatus according to claim 1, further comprising a tension adjuster which adjusts tension on the sheet, wherein the controller controls the positional relationship between the image carrier and the sheet by changing tension on the sheet with the tension adjuster.

6. The image forming apparatus according to claim 1, further comprising a belt contact member which comes into contact with a belt as the image carrier, wherein the controller controls the positional relationship between the image carrier and the sheet by changing a position of the belt contact member.

7. A control method for an image forming apparatus including an image carrier which is configured to carry a toner image, and a transfer unit, the image carrier and the transfer unit forming a transfer nip for receiving a sheet, the transfer unit configured to transfer onto the sheet the toner image carried by the image carrier when the sheet enters the transfer nip after contacting the image carrier at a contact start position on the image carrier that is at a distance upstream from the transfer nip, the method comprising:

detecting, by a curled amount detector, a curled amount of the sheet upstream from the transfer nip, wherein the sheet is a roll-type continuous sheet that is conveyed toward the image carrier from a roll, and the curled amount detector detects the curled amount of the sheet based on an outer diameter of the roll; and controlling a positional relationship between the image carrier and the sheet so that the distance is within a predetermined range when the sheet enters the transfer nip during an image forming job, and the distance is within the predetermined range as the detected curled amount changes.

8. The control method according to claim 7, further comprising controlling the positional relationship between the image carrier and the sheet based on the contact start position, the contact start position having been detected by a contact start position detector.

9. The control method according to claim 7, further comprising changing the contact start position according to a type of the sheet.

10. The control method according to claim 7, further comprising controlling the positional relationship between the image carrier and the sheet by changing a posture of the sheet with a sheet passing guide member which is provided upstream of the transfer nip to guide the sheet to the transfer nip.

11. The control method according to claim 7, further comprising controlling the positional relationship between the image carrier and the sheet by changing tension on the sheet with a tension adjuster which adjusts the tension on the sheet.

12. The control method according to claim 7, further comprising controlling the positional relationship between the image carrier and the sheet by changing a position of a belt contact member which comes into contact with a belt which is the image carrier.

* * * * *